United States Patent [19]

Wright

[11] Patent Number: 5,044,668

[45] Date of Patent: Sep. 3, 1991

[54] CHECK CHECKER SYSTEM

[76] Inventor: Lyle E. Wright, P.O. Box 127, Lanham, Md. 20703

[21] Appl. No.: 575,685

[22] Filed: Aug. 31, 1990

[51] Int. Cl.[5] ..... B42D 15/00

[52] U.S. Cl. ..... 283/058; 283/82

[58] Field of Search ..... 283/58, 59, 72, 67, 283/82

[56] References Cited

U.S. PATENT DOCUMENTS

| | | | |
|---|---|---|---|
| 3,112,151 | 11/1963 | Buros | 283/58 |
| 3,363,917 | 1/1968 | Gunderson et al. | 283/58 |
| 4,346,442 | 8/1982 | Musmanno | 283/58 |
| 4,588,211 | 5/1986 | Greene | 283/58 |
| 4,630,844 | 12/1986 | Troy et al. | 283/67 |
| 4,675,669 | 6/1987 | Goldman | 283/72 |
| 4,948,174 | 8/1990 | Thomson et al. | 283/58 |

*Primary Examiner*—Frank T. Yost
*Assistant Examiner*—Hwei-Siu Payer

[57] ABSTRACT

1. The invention allows the use of an ordinary bank check with the exception, the CC TM bank check will have a magnetic stripe carrying the necessary data to be read by a magnetic swipe-style reader. The magnetic swipe-style reader will transfer the data to a programmed computer system. The CCS TM account holder of the CC TM bank check will use the CC TM bank check to verify his credit and to transfer funds for the payment of his purchases at the point-of-sale.

2. The CC TM bank check may have a bar code carrying the necessary data to be read by a bar code optical/-laser reader. The bar code optical/laser reader will transfer the data to a programmed computer system.

1 Claim, 1 Drawing Sheet

CHECK CHECKER SYSTEM

REFERENCE CITED

U.S. Pat. No.
3,624,357, Nov. 1971, Wright.

SUMMARY

CHECK CHECKER TM (CC TM) is a bank check that is issued by an American bank and sometimes by others. The CC TM bank checks are issued by the bank after the customer has established a CCS TM bank account with his bank. The CC TM bank check is designed to carry a magnetic stripe or bar code, located on either the front/face or back/reverse of the CC TM bank check depending on the design of the check. The magnetic stripe or bar code will carry the account information. The magnetic stripe or bar code will be read by a magnetic swipe-style reader or a bar code optical laser reader which will be linked to a central computer. Data will be carried by telephone wire, direct line, radio, or the alike, which in a matter of seconds will indicate on the magnetic swipe-style reader or bar code optical laser reader if the transaction is approved or denied. When approval of the CC TM bank check is received, the merchant will accept the CC TM bank check and the sale will be finalised. The object of the invention is to restrain fraud and to save time at the point-of-sale (POS).

DETAILED DESCRIPTION OF THE DRAWINGS

Figure 1:
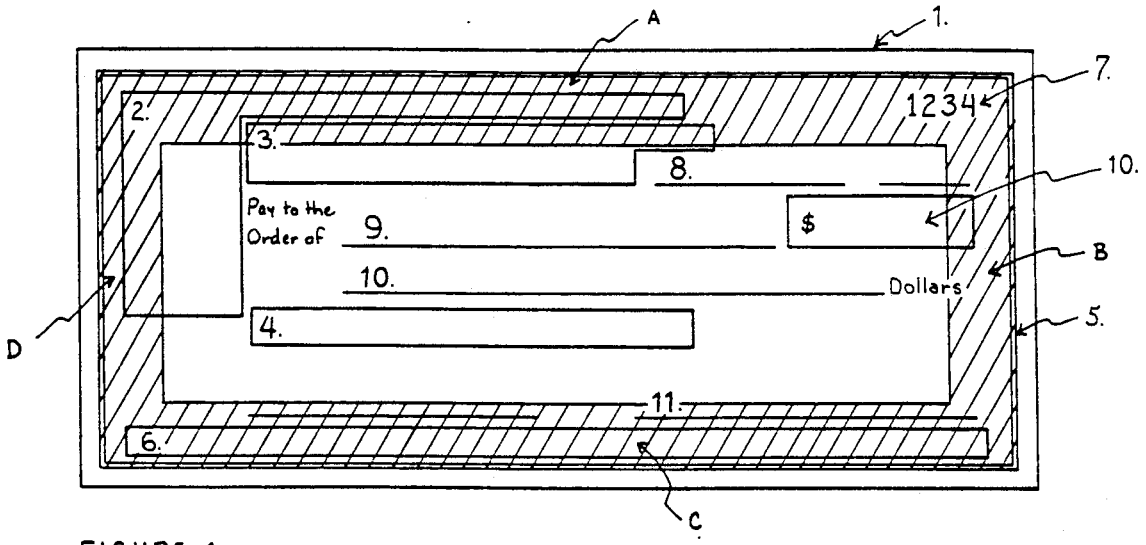
FIG. 1 Shows the front/face of the CC TM bank check.

FIG. 1 shows the front/face of the CC TM bank check:

(1) CC TM bank check to be printed on top quality bank check paper;
(2) CCS TM trademark to be printed by check manufacturer.
(3) Name and address of CCS TM account holder.
(4) Name and address of CCS TM account holer's bank.
(5) CCS TM magnetic strip or bar code to be printed by the check manufacturer.
(6) Bank identification and CCS TM account number; standard printing by the check manufacturer.
(7) Standard bank check number printed by check manufacturer.
(8) Date. To be written in by CCS TM account holder at time of transaction.
(9) Payee. To be written in by CCS TM account holder at time of transaction.
(10) Amount of CCS TM bank check. To be written in by CCS TM account holder at time of transaction.
(11) Signature of CCS TM account holder. To be executed at time of transaction.

Note: (5)—CCS TM magnetic stripe or bar code may be printed in positon A, B, C or D as shown.

Figure 2:
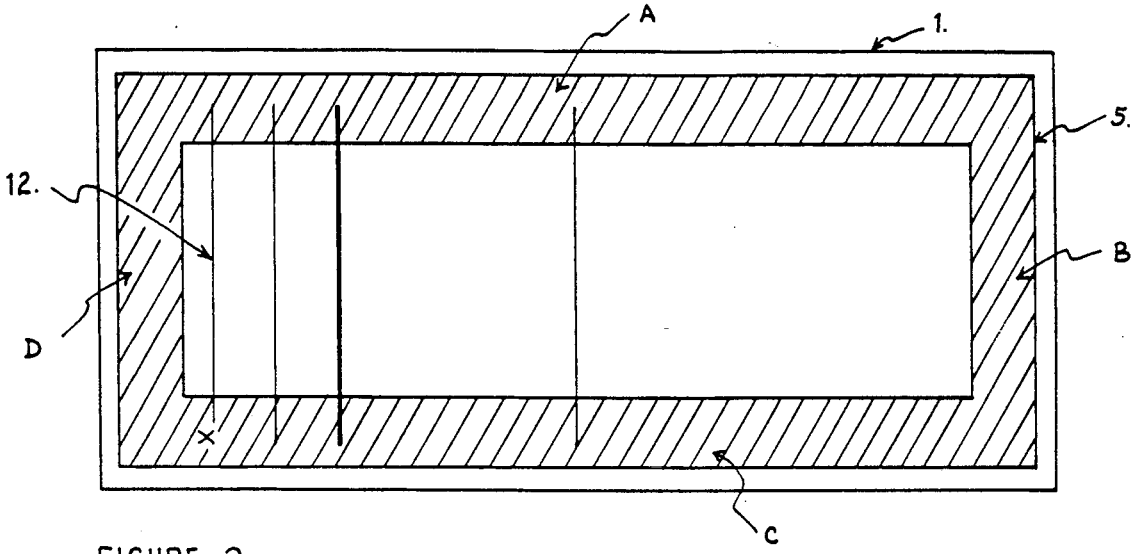
FIG. 2 Shows the back/reverse of the CC TM bank check.

FIG. 2 Shows the back/reverse side of the CC TM bank check:

(12) Space delegated by bank for endorsement of CC TM bank check.

(5) CCS TM magnetic stripe or bar code to be printed by the check manufacturer.

Note: (5)—CCS TM magnetic stripe or bar code may be printed in positon A, B, C or D as shown.

Figure 3:
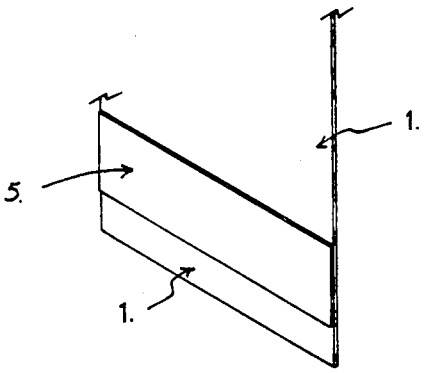
FIG. 3 shows detail of magnetic strip.

FIG. 3 shows th detail of magnetic strip showing the position of placement on the check.

BACKGROUND OF THE INVENTION

The invention relates to credit card check transaction systems and, more particularly, to a system whereby the sales document is a negotiable instrument and is credited to the seller's account and debited against the buyer's account.

DESCRIPTION OF THE PRIOR ART

It has heretofore been the accepted practice in the credit industry to issue credit cards where evidence established credit in card holder or owner with a credit card agency. The cards are used in various types of transactions, however the art of the Trademark Bank Check, known as CHECK CHECKER TM or CC TM bank check, offers new art of credit or cash transaction systems.

DESCRIPTION

The CHECK CHECKER SYSTEM TM, sometimes known as CCS TM, is a transaction system using a special design in manufactured bank checks similar in characteristics to the bank check as we know it today. Referring to FIG. 1, the CHECK CHECKER TM (CCS TM) bank check is designed to show the name of the bank (4), the name of the CCS TM account holder (3), The amount of the CC TM bank check (10) and space for the CCS TM account holder's signature (11), and the trademark (2). On the front of the instrument or CC TM bank check a magnetic stripe or bar code (5) may appear and be attached to the bank check at position A, B, C or D, whichever position is acceptable and workable to and with a suitable magnetic swipe-style reader or bar code optical laser reader, similar to the various optical readers which are being used mostly for the plastic credit cards we are familiar with at this date. This magnetic strip or bar code (5) may appear at position A, B, C, or D on the back/reverse side of the CCS TM bank check FIG. 2. The CC TM bank check will carry the following identification numbers as required by the bank: bank transfer number and customer account number (6). The magnetic strip materials will be of methyl methacrylate and azores catalysts and shall be applied similar to printing ink, the methyl methacrylate material is not considered an ink however and certain temperatures have to be maintained to cause the methylmethacrylate material to polymerize or become a solid.

The bank will issue the CCS TM account to its customer. The CCS TM system will be franchised to the banks and to the merchants. The merchants will recognise the trademark on the CC TM bank check.

The CCS TM account holder (customer) will find out the CC TM bank check, starting with the date (8), then the payee (9), the amount of the transaction (10) and will furnish his/her signature (11). The merchant or the point-of-sale (POS) clerk will take the CC TM bank check and check the date (8), the amount (10), the name of the CCS TM account holder (3) and his/her signature (11). The POS clerk then slide the CC TM bank check through or on the magnetic swipe-style reader or bar code optical laser reader and key in the amount of the transaction. The magnetic swipe-style reader or the bar code optical/ laser reader readout will indicate either approval or disapproval in accordance with the data coming from its control computer system. If the magnetic swipe-style reader or bar code optical laser reader indicates approval of the CC TM bank check, the CC TM bank check will be treated the same as cash at the point-of-sale. If the computer does not approve the CC TM bank check then the sale is null and void. The computer may debit the CCS TM account holder/purchaser's account and/or credit the merchant's account. The CC TM instrument becomes recognizable by its quick verification of its value with the bank.

The bank will charge a fee for the printing of the CC TM bank checks. the CC TM bank check instrument may be used as a traveler's check. In addition, the bank may use the CCS TM in conjunction with an overdraft system as well as other banking systems.

A claim where the individual may request from his bank the convenient pocket CC TM bank check as previously printed in its entirety with the exception of the date and CCS TM account holder's signature. The date and CCS TM account holder's signature will be applied at time of purchase. The special CC TM bank checks may be offered in amounts of $5, $10, $15, $20 and $25 depending on the CCS TM account holder's request. These special CC TM bank checks will be printed payable to CASH and will be considered and treated as a cash transaction. These CC TM bank checks will be backed by the CCS TM account holder's bank. These special CC TM bank checks are not to be confused with the regular/original CC TM bank checks where the CCS TM account holder fills in the payee's name, the amount of the transaction, as well as the date and his/her signature.

I claim:

1. A bank check comprising a magnetic strip, said magnetic strip being of methyl methacrylate and azores catalysts, said magnetic strip carrying electronic data to be read by reader means, whereby said data will be transferred to various computer networks to determine approval or rejection of said bank check at time of submission.

* * * * *